United States Patent [19]

Murayama et al.

[11] Patent Number: 4,557,675

[45] Date of Patent: Dec. 10, 1985

[54] SCROLL-TYPE FLUID MACHINE WITH BACK PRESSURE CHAMBER BIASING AN ORBITING SCROLL MEMBER

[75] Inventors: Akira Murayama; Hiroaki Kuno; Naoshi Uchikawa; Takahiro Tamura; Takao Mizuno, all of Shimizu; Sumihisa Kotani, Ibaraki; Yoshikatsu Tomita, Shizuoka; Tetsuya Arata, Shimizu; Masao Shiibayashi, Shimizu; Kazutaka Suefuji, Shimizu, all of Japan

[73] Assignee: Hitachi, Ltd., Tokyo, Japan

[21] Appl. No.: 621,371

[22] Filed: Jun. 18, 1984

[30] Foreign Application Priority Data

Jun. 17, 1983 [JP] Japan ..... 58-107651

[51] Int. Cl.[4] ..... F01C 1/04

[52] U.S. Cl. ..... 418/55; 418/57

[58] Field of Search ..... 418/55, 57, 59

[56] References Cited

U.S. PATENT DOCUMENTS

| | | | |
|---|---|---|---|
| 3,884,599 | 5/1975 | Young et al. | 418/55 |
| 3,994,633 | 11/1976 | Shaffer | 418/55 |
| 4,365,941 | 12/1982 | Tojo et al. | 418/57 |
| 4,475,874 | 10/1984 | Sato | 418/57 |

FOREIGN PATENT DOCUMENTS

| | | | |
|---|---|---|---|
| 53-119412 | 10/1978 | Japan | 418/57 |

*Primary Examiner*—John J. Vrablik

*Attorney, Agent, or Firm*—Antonelli, Terry & Wands

[57] ABSTRACT

A scroll-type fluid machine having an orbiting scroll member and a stationary scroll member each having an end plate and a spiral wrap of at least two turns protruding upright from one of the sides of the end plates. The orbiting scroll member has a back pressure chamber formed on the back side thereof and communicating with the compression spaces of the fluid machine through pressure equalizing ports formed in the orbiting scroll member, so that the pressure of the fluid under compression is introduced to the back pressure chamber to produce an axial thrusting force for pressing the orbiting scroll member towards the stationary scroll member. The positions of the pressure equalizing ports in terms of the wrap angle λ of the wraps are selected to meet the following condition:

$$\lambda d > \lambda > \lambda d - 2\pi,$$

where, λd represents the wrap angle of the wraps when the volume of the compression spaces is minimized. The equalizing ports are positioned at λ and λ+2 π.

6 Claims, 10 Drawing Figures

SCROLL-TYPE FLUID MACHINE WITH BACK PRESSURE CHAMBER BIASING AN ORBITING SCROLL MEMBER

BACKGROUND OF THE INVENTION

The present invention relates to scroll-type fluid machine, for providing a stable high performance over a wide range of operating conditions.

In, for example, a hermetic scroll type compressor for a refrigeration cycle a scroll-type compression mechanism and a driving motor for driving the mechanism are provided, with the compression mechanism and the motor being hermetically encased by a common casing. The scroll-type compression mechanism includes a stationary scroll member, an orbiting scroll member orbiting with respect to the stationary scroll member, a crankshaft connected to the driving motor for causing the orbiting movement of the orbiting scoll member, and a frame for carrying the stationary and orbiting scroll members as well as the crankshaft. One important requisite for a hermetic scroll compressor is the avoidance of an internal leakage of the fluid under compression. More particularly, as the fluid pressure of the compressor is increased, the axial force produced by the compressed fluid acting to axially separate the stationary and orbiting scroll members is increased to unfavorably increase the tendency of the fluid to leak internally from the high-pressure side to the low-pressure side. To avoid this problem in, for example, U.S. Pat. No. 4,365,941, the fluid of a medium pressure under compression is led to the back side of the end plate of the orbiting scroll member to generate an axial thrust force thereby axially pressing the orbiting scroll member into close contact with the stationary scroll member. In, for example, U.S. Pat. No. 3,884,599 another solution is proposed wherein a high fluid pressure is continuously applied to a back side of the end plate of the orbiting scroll member to maintain the orbting scroll member in close contact with the stationary scroll member. However, these proposals are unsatisfactory since in the arrangement of U.S. Pat. No. 4,365,941, the pressure applied to the back side of the orbiting scroll member is derived from a predetermined portion of the compression chamber formed between the wraps of the orbiting and stationary scroll members and, therefore, is determined solely by the suction pressure of the compressor regardless of, for example, the discharge pressure of the compressor. Therefore, when the discharge pressure of the compressor is increased, the axial separating force tending to axially separate the orbiting and stationary scroll members from each other is increased to overcome the axial force produced by the fluid pressure acting on the back side of the end plate of the orbiting scroll member. Consequently, the gap between the axial end of the wrap of the orbiting scroll member and the end plate of the stationary scroll member is increased to allow the internal leakage of the fluid under compression thereby lowering the volumetric efficiency and seriously impairing the compression performance of the compressor. The increased rate of internal leakage of the fluid increases the leak of the lubricating oil suspended by the fluid, so that the driving torque of the compressor is increased due to an increment of the frictional resistance attributable to shortage of the oil which constitutes the oil film between the ends of the wraps and opposing end plates. Consequently, the load imposed on the driving motor is disadvantageously increased. The lubricating oil is usually supplied through an axially extending oil passage in the crankshaft, with the oil being supplied through the oil passage being discharged to a space formed between the upper end of the crankshaft and a bearing boss provided on the back side of the orbiting scroll member, and the oil then being distributed to portions requiring lubrication such as, for example, an area of contact between the orbiting and stationary scroll members. Therefore, an excessive internal leakage of the lubricating oil may cause an upward shifting of the crankshaft due to a reduction of the oil pressure in the space between the upper end of the crankshaft and the bearing boss. The upward shifting of the crankshaft will bring the end surface thereof for carrying a balance weight into contact with the end surface of the bearing boss, resulting in an increased frictional resistance and, hence, a greater power demand for the driving motor as well as a rapid wear of the contacting surfaces.

On the other hand, in the arrangement of U.S. Pat. No. 3,884,599, the axial force for pressing the orbiting scroll member into closer contact with the stationary scroll member is determined solely by the discharge pressure of the compressor. Therefore, if the pressure in the low-pressure side of the refrigeration cycle is lowered to reduce the suction pressue of the compressor, the internal pressure of the compressor is lowered to decrease the axial separating force acting between the orbiting and stationary scroll members. Consequently, the axial pressing force produced by the fluid pressure acting on the back side of the orbiting scroll member is increased, which, in turn, seemingly increases the resistance caused by the friction between the orbiting and stationary scroll members, requiring a greater input by the driving motor.

To avoid these problems, some proposals of operating the compressor under limited operating pressure and forming lubricating oil grooves in the axial end surfaces of the wraps of both scroll members to enhance the wear resistance and the sealing efficiency have been made such as in, for example, U.S. Pat. No. 3,994,633.

Accordingly, an object of the invention is to provide a scroll-type fluid machine which can stably operate so as to exhibit high performance over a wide range of operating conditions, without requiring any limitation of operating pressure and without requiring any specific anti-friction and sealing construction on the axial end surfaces of the wraps of scroll members.

In accordance with the invention, a scroll-type fluid machine includes an orbiting scroll member and a stationary scroll member each having an end plate and a spiral wrap protruding upright from one of the sides of the end plates, with the orbiting scroll member and said stationary scroll member being assembled together with their wraps meshing with each other such that compression spaces of varying volume are defined by said end plates and said wraps of said orbiting and stationary scroll members. The orbiting scroll member is adapted to make an orbiting movement with respect to the stationary member so that the compression spaces are progressively moved radially inwardly while decreasing their volumes. The said orbiting scroll member having a back pressure chamber formed on the back side thereof and communicating with the compression spaces of decreasing volume through pressure equalizing ports formed in the orbiting scroll member, wherein each of the wraps has at least two turns and, wherein the positions of the pressure equalizing ports in terms of the wrap angle λ of the wraps meet the following condition:

$$\lambda d > \lambda > \lambda d - 2\pi$$

where, λd represents a wrap angle of the wraps when the volume of the compression spaces is minimized. The equalizing ports are positioned at λ and $\lambda + 2\pi$.

According to this arrangement, the pressure introduced into the back pressure chamber on the back side of the orbiting scroll member through the pressure-equalizing ports is affected by the discharge pressure of the compressor and the pressure under the compression. Since the pressure of the fluid under compression is determined by the suctin pressure of the compressor, the axial pressing force for pressing the orbiting scroll member into contact with the stationary scroll member is determined in the scroll-type fluid machine of the invention by the suction pressure and the discharge pressure. Therefore, even if the compression ratio of the compressor is changed due to a change in the suction pressure and/or the discharge pressure, the pressure acting in the back pressure chamber is changed following the change in the internal pressure of the compressor so that the end plate of the orbiting scroll member can be stably pressed at a moderate force which is neither too large nor too small.

It is, therefore, possible to obtain a high performance and stable operation of a scroll-type fluid machine over a wide range of operating conditions, without requiring any limitation of the operating pressure and without requiring specific antifriction or sealing measures on the end surfaces of the wraps of the orbiting and stationary scroll members.

According to the invention, one pressure-equalizing port can take any desired position within the range of $\lambda d > \lambda > \lambda d - 2\pi$, while each pressure-equalizing port is formed at a position near to the wrap of the orbiting scroll member to be of a diameter substantially equal to or smaller than the width of the wrap of the stationary scroll member. As the position of the pessure-equalizing port gets nearer to the position λd, the back pressure chamber is maintained in communication with the compression space for a longer period of time and, hence, the pressure in the back pressure chamber is more significantly affected by the pressure in the compression space than by the discharge pressure. That is, the mean value of the pressure acting on the rear side of the orbiting scroll member becomes closer to the pressure of the fluid under compression. In contrast, as the position of the pressure-equalizing port gets closer to the position $\lambda d - 2\pi$, the pressure in the back pressure chamber is affected more significantly by the discharge pressure than in the case where the port takes a position near the position λd. Consequently, the mean value of the pressing pressue is increased to produce a greater force for urging the orbiting scroll member into contact with the end plate of the orbiting scroll member.

For reducing the frictional resistance, the force for pressing the orbiting scroll member into contact with the stationary scroll member should be decreased. From this point of view, it is preferred that the pressure-equalizing port takes a position near the position λd.

The above and other objects, features and advantages of the invention will become more apparent from the following description of the preferred embodiment when the same is read in conjunction with the accompanying drawings.

DETAILED DESCRIPTION

Figure 1:
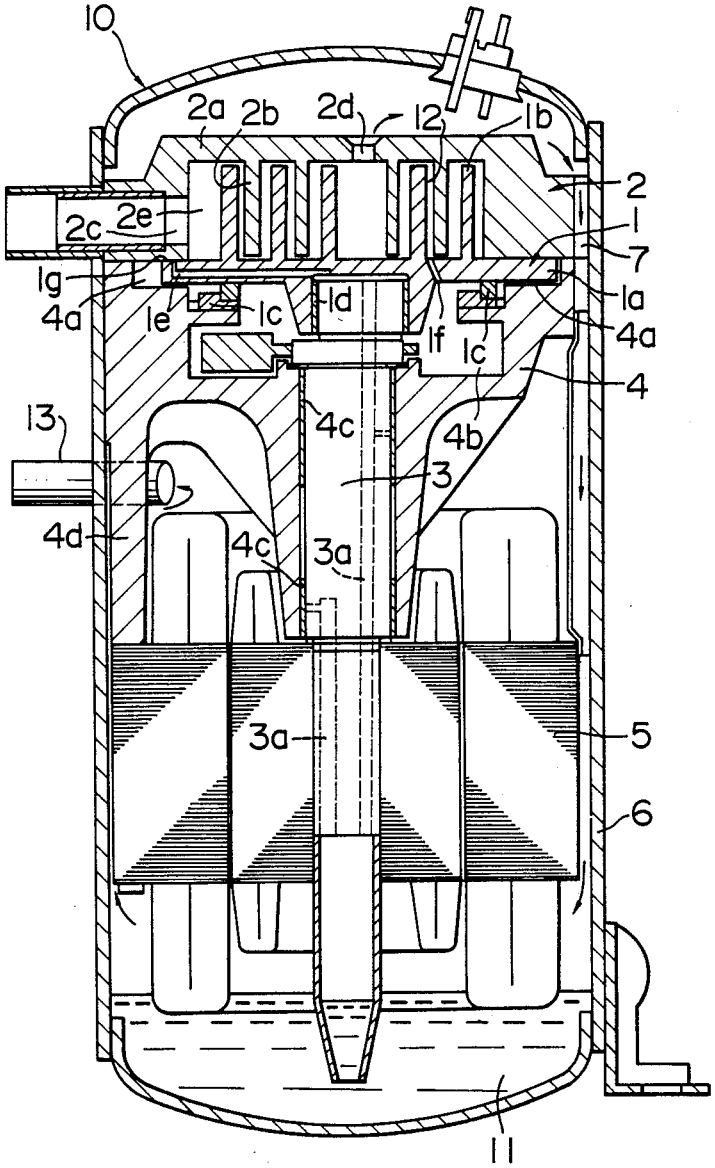
FIG. 1 PRIOR ART
FIG. 1 is a longitudinal sectional view of a hermetic scroll compressor constructed in accordance with the invention.

Referring to the drawings wherein like reference numerals are used throughout the various views to designate like parts and, more particularly, to FIG. 1, according to this figure, a hermetic scroll compressor generally designated by the reference numeral 10, such as, for example, a scroll-type fluid machine, includes a scroll-type compression mechanism having a stationary scroll member generally designated by the reference numeral 2, an orbiting scroll member generally designated by the reference numeral 1 adapted to make an orbiting motion with respect to the stationary scroll member 2, a crankshaft generally designated by the reference numeral 3 and a frame generally designated by the reference numeral 4, with the orbiting scroll member 1 being adapted to be driven by a driving motor 5, and with the compression mechanism and the driving motor 5 being encased hermetically by a common casing 6.

The orbiting scroll member 1 has an end plate 1*a* and a spiral wrap 1*b* protruding upright from one side of the end plate 1*a*, with the end plate 1*a* being provided on a back side thereof with a mechanism 1*c* for preventing the orbiting scroll member 1 from rotating around its own axis, as well as a swivel bearing 1*d* adapted for receiving the eccentric crank pin portion of the crankshaft 3. The space in the swivel bearing 1*d* communicates with the front side of the end plate 1*a* carrying the wrap 1*b* through an oil supply port 1*e* formed through a thickness of the end plate 1*a*.

The stationary scroll member 2 has an end plate 2*a* and a spiral wrap 2*b* protruding upright from one side of the end plate 2*a*. The end plate 2*a* is provided with a suction port 2*c* and a discharge port 2*d*.

The orbiting scroll member 1 and the stationary scroll member 2 are assembled together such that their wraps 1*b*, 2*b* mesh with each other to define therebetween compression spaces which will be explained later.

The frame 4 is provided with a recess 4*a* which permits the end plate 1*a* of the orbiting scroll member 1 to make an orbiting movement therein with the end plate 1*a* of the orbiting scroll member 1 received in the recess 4*a*. The stationary scroll member 2 and the frame 4 are rigidly connected to each other to hold the orbiting scroll member 1 therebetween. The frame 4 is further provided with a bearing 4*c* for bearing the crankshaft 3 and legs or stays 4*d* for supporting the motor 5.

The frame 4 and the stationary scroll member 2, together as a unit, are disposed in the casing 6 so as to divide the space in the casing 6 into an upper section and a lower section. The arrangement is such that the lubricating oil and the gas can hardly leak at all through the gaps formed between the casing 6 and the unitary body constituted by the frame 4 and the stationary scroll member 2. A discharge passage 7, providing a communication between the upper and lower sections of the casing 6, is formed in the outer periphery of the frame 4 and the stationary scroll member 2.

The crankshaft 3 is provided therein with axially extending lubricating oil passages 3*a* through which a lubricating oil 11 is drawn from the bottom of the casing 6 and supplied to the swivel bearing 1*d* and the bearing 4*c* by a pressure differential. A back pressure chamber 4*b* is formed on the back side of the orbiting scroll member 1, with the back pressure chamber 4*b* being defined by the end plate 1*a* of the orbiting scroll member 1 and the frame 4, and being in communication with the space in the casing 6, or compression chamber 12 formed between the wraps 1*b*, 2*b* and end plates 1*a*, 2*a* of the orbiting and stationary scroll members 1, 2, through pressure equalizing ports 1*f* formed in the orbiting scroll member 1.

In operation, as the motor 5 is energized to drive the crankshaft 3, the orbiting scroll member 1 makes an orbiting motion with respect to the stationary scroll member 2 by the operation of the crankshaft 3 and the rotation prevention mechanism 1*c*, so that the compression spaces, formed between both scroll members 1, 2, are progresively moved radially inwardly while decreasing their volumes, thereby compressing the gas drawn through the suction port 2*c* and discharging the same through the discharge port 2*d*. The gas discharged from the discharge port 2*d* is passed through the discharge passage 7 and is forced out from the casing 6 through a discharge pipe 13. The compressed gas is then circulated through a referigeration cycle and is returned to the suction port 2*c* of the compressor.

During the operation of the compressor, the gas under compression in the compressor produces an axial separating force which acts to separate the two scroll members 1, 2 away from each other in the axial direction. The separation of the scroll members 1, 2 from each other, however, can be avoided by pressing the orbiting scroll member 1 against the stationary scroll member 2, by maintaining the pressure in the back pressure chamber 4*b* at a level which is higher than the suction pressure but lower than the discharge pressure.

Meanwhile, the lubricating oil which has been supplied to the swivel bearing 1*d* and the beaing 4*c* through the oil passages 3*a* in the crankshaft 3 is forced into the back pressure chamber 4*b* by the pressure differential between the internal pressure of the casing 6 and the pressure in the back pressure chamber 4*b*. The oil is then discharged to the compression space 12 through the pressure-equalizing ports 1*f*. On the other hand, a part of the lubricating oil supplied to the swivel bearing 1*d* is introduced to the sliding portion 1*g* of the end plate of the orbiting scroll member 1 through the oil supply port 1*e*, and is discharged to a suction chamber 2*e*.

Figure 2:
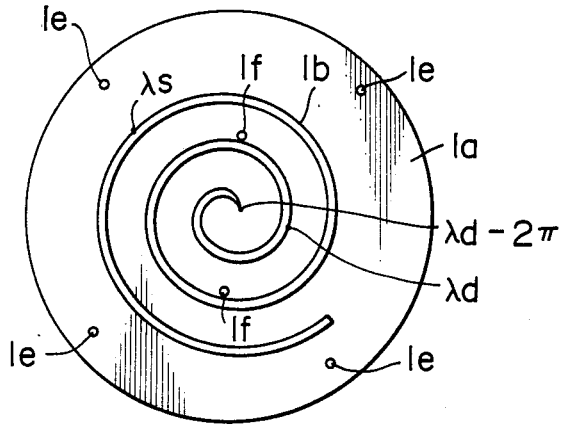
FIG. 2 PRIOR ART
FIG. 2 is a plan view of an orbiting scroll member incorporated in the compressor of FIG. 1.
Figure 3:
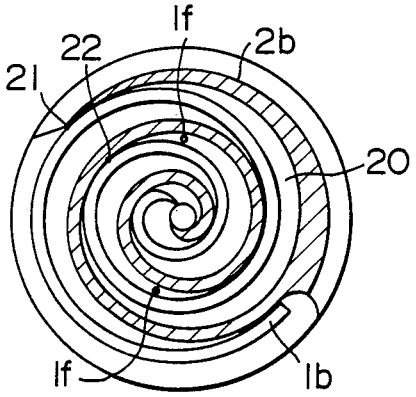
FIG. 3 PRIOR ART
FIG. 3 is a cross-sectional view the wraps of the compressor of FIG. 1 in the state of forming compression spaces of maximum volume.
Figure 4:
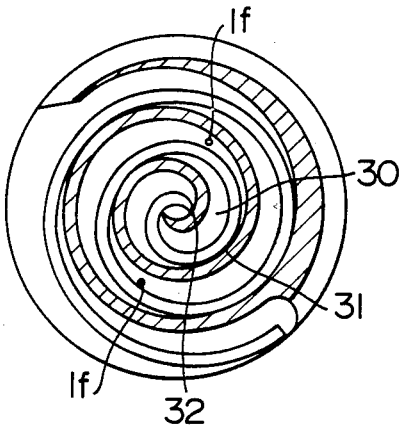
FIG. 4 PRIOR ART
FIG. 4 is a cross-sectional view of the FIG. 3 in a state of forming compression spaces of minimum volume.

Referring to FIGS. 2 to 4, the wrap angle of the wrap 1*b* of the orbiting scroll member is represented by $\lambda$. The wrap angle of the wrap 1*b*, at which the space 20 of the maximum volume, is formed is represented by $\lambda s$, while the wrap angle of the wrap 1*b* at which the space 30 of the minimum volume is formed is represented by $\lambda d$. In FIG. 3, the wrap 1*b* of the orbiting scroll member 1 and the wrap 2*b* of the stationary scroll member 2 contact each other at points 21, 22 when the space 20 of the maximum volume is formed. The point 21 coincides with the point $\lambda s$ on the wrap 1*b* of the orbiting scroll member 1 shown in FIG. 2. It will be seen that two compression spaces of maximum volume are formed simultaneously in symmetry with each other. Referring to FIG. 4, the wraps 1*b* 2*b* contact each other at points 31, 32. In this state, the wraps form the space 30 of the minimum volume. The point 31 coincides with the point $\lambda d$ on the wrap 1*b* shown in FIG. 2, while the coinciding point 32 is located at the position $\lambda d-2\pi$. Two compression spaces of minimum volume are simultaneously formed.

Figure 5:
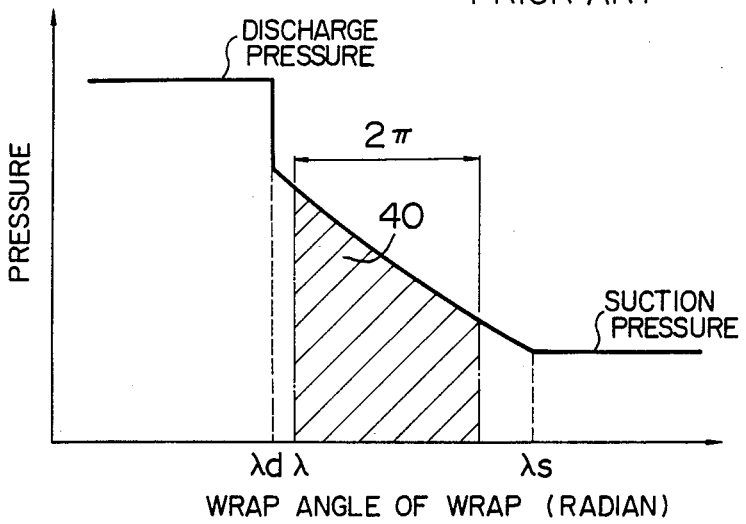
FIG. 5 PRIOR ART
FIG. 5 is a graphical illustration of a relationship between the pressure change in the area around a pressure-equalizing port of the orbiting scroll member as shown in FIG. 2 and the wrap angle of the orbiting scroll member.
Figure 6:
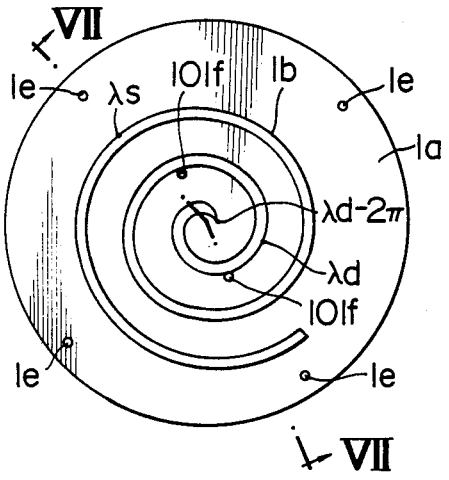
FIG. 6 is a plan view of an orbiting scroll member incorporated a scroll compressor according to the invention.
Figure 7:
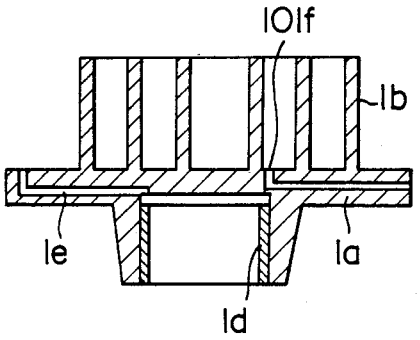
FIG. 7 is a sectional view of the orbiting scroll member of FIG. 6.

It is assumed here that the pressure-equalizing ports 1*f*, which provide the communication between the back pressure chamber 4*b* and the compression chamber 12 between both scroll members 1 and 2, are positioned within a range which is given by $\lambda d \leqq \lambda \leqq \lambda s$. In such a case, the pressure in the compression chamber 12 is changed within the range corresponding to the range of between $\lambda$ and $\lambda+2\pi$ in terms of the wrap angle of the wrap 1*b*, as will be seen from FIG. 5. In this case, the mean pressure throughout one cycle of the orbiting motion is expressed by the mean value of the hatched area 40. Consequently, the mean pressure is determined by the suction pressure so that the axial separating force which tends to axially separate the scroll members 1, 2 from each other is increased as the discharge pressure is increased.

When the pressure-equalizing ports are located within the range specified above, the axial separating force is increased as the discharge pressure of the compressor is increased so that both scroll members are axially separated from each other to form large gaps between the axial ends of the wraps 1*b*, 2*b* and the opposing end plates 2*a*, 1*a* to increase the rate of internal leakage of the fluid, as well as the rate of discharge of the lubricating oil from the sliding area 1*g* of the end plate 1*a* of the orbiting scroll member 1 into the suction chamber 2*e*. Consequently, the volumetric efficiency of the compressor is decreased and the demand for input power is uneconomically increased thereby seriously impairing the performance of the compressor. The excessive discharge of the lubricating oil from the sliding area 1*g* of the end plate of the orbiting scroll member 1 causes a substantial drop of the pressure acting on the end of the crank pin portion of the crankshaft 3, which, in turn, allows the crankshaft 3 to move upwardly, thus causing accidental contact between the crankshaft 3 and the orbiting scroll member 1.

These problems, however, are completely eliminated in the scroll-type fluid machine of the invention since the position of each pressure-equalizing port 101*f* formed in the orbiting scroll member 1, in terms of the wrap angle λ of the wrap 1*b*, is selected to fall within the range of $\lambda d > \lambda > \lambda d - 2\pi$, where λd represents the wrap angle of the wrap 1*d* forming the compression space of minimum volume.

Figure 10:
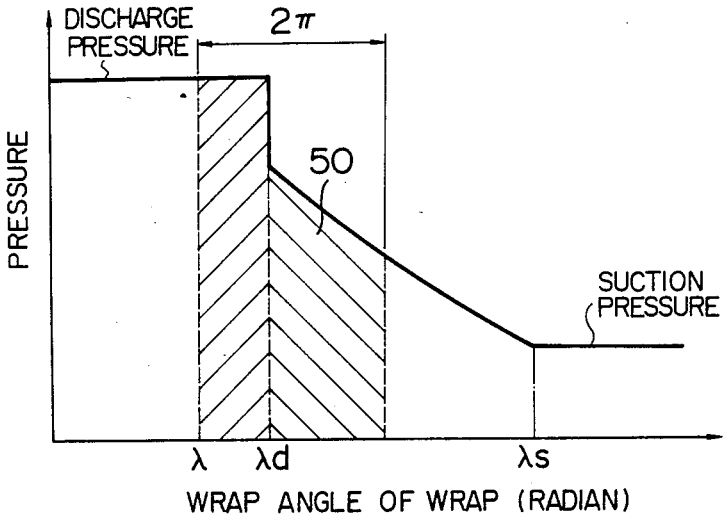
FIG. 10 is a graphical illustration of a relationship between the pressure in the area around the pressure-equalizing port of the orbiting scroll member FIG. 6 and the wrap angle of the orbiting scroll member.

According to this arrangement, the pressure at the position of the wrap angle λ is changed within the range of between $\lambda + 2\pi$ and λ as shown in FIG. 10. Since λ is smaller than λd, the pressure in the region of between λ and λd is determined by the discharge pressure, while in the region between λd and $\lambda + 2\pi$, the pressure is determined by the suction pressure. Consequently, the mean value of the pressure expressed by the hatched area 50 in FIG. 10 is applied to the back pressure chamber communicating with the pressure equalizing ports 101*f*. Thus, the pressure in the back pressure chamber is changed in response to both the suction pressure and the discharge pressure.

Figure 8:
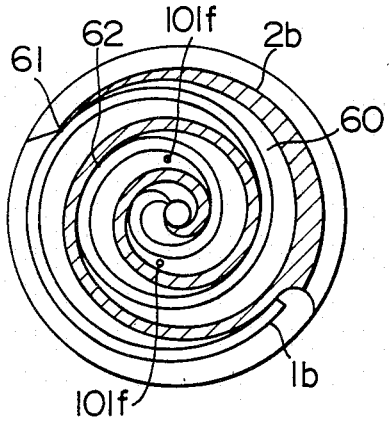
FIG. 8 is a cross-sectional plan view of the wraps of the compressor according to the invention in the state of forming compression spaces of maximum volume.
Figure 9:
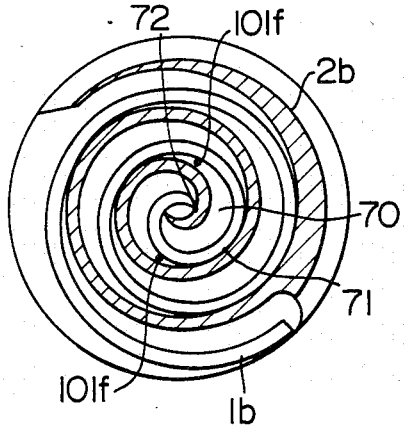
FIG. 9 is a cross-sectional plan view of the wraps of FIG. 8 in state of forming compression spaces of minimum volume.

FIG. 8 shows the state in which a space 60 of maximum volume is formed between the wraps of both scroll members. In this state, the wrap 1*b* of the orbiting scroll member 1 and the wrap 2*b* of the stationary scroll member 2 make contact with each other at the two points 61, 62. On the other hand, FIG. 9 shows the state in which a space 70 of minimum volume is formed between the wraps of two scroll members. In this state, the wraps 1*b* and 2*b* contact each other at the two points 71, 72.

Therefore, as the discharge pressure is increased to thereby increase the axial separating force between two scroll members 1, 2, the pressure in the back pressure chamber on the back side of the orbiting scroll member 1 is increased correspondingly to effectively suppress the separation of the two scroll members 1, 2 from each other. It is thus possible to obtain a stable operation of the scroll-type fluid machine over a wide range of operating conditions.

As has been described, according to the invention, the pressure acting on the back side of the orbiting scroll member 1 is determined by both the suction pressure and the discharge pressure of the compressor, so that the force for maintaining close contact between the orbiting scroll member 1 and the stationary scroll member 2 is increased or decreased in response to an increase and decrease of the axial separating force acting between the two scroll members 1, 2, so that the scroll-type fluid machine can operate stably to full capacity over a wide range of operating conditions.

Further, each pressure-equalizing port is formed at a position close to the wrap of the orbiting scroll member 1 to have a diameter substantially equal to or smaller than the width of the wrap of the opposing stationary scroll member 2. Thus, each pressure-equalizing port is closed with the wrap of the stationary scroll member 2, when the wraps of the scroll members 1, 2 come into contact with each other every orbiting motion at the position of each pressure-equalizing port to define the boundary of compression spaces. Accordingly, the pressure in the back pressure chamber as well as that in the pressure-equalizing port area is varied continuously as the orbiting scroll member makes an orbiting motion with respect the stationary scroll member 2. Also, it is possible to prevent a leakage of pressure between adjoining compression spaces from being caused at the position of each pressure-equalizing port.

What is claimed is:

1. A scroll-type fluid machine comprising:

an orbiting scroll member and a stationary scroll member each having an end plate and a spiral wrap protruding upright from one of the sides of said end plates, said orbiting scroll member and said stationary scroll member meshing with each other such that compression spaces of varying volume are defined by said end plates and said wraps of said orbiting and stationary scroll members, said orbiting scroll member being adapted to make an orbiting movement with respect to said stationary member so that said compression spaces are progressively moved radially inwardly while their volumes are decreased, said orbiting scroll member having a back pressure chamber formed on a backside thereof and communicating with said compression spaces of decreasing volume through pressure equalizing ports positioned at λ and $\lambda + 2\pi$ formed in said orbiting scroll member, each of said wraps has at least two turns and the positions of said pressure equalizing ports in terms of the wrap angle λ of said wraps meet the following condition:

$$\lambda d > \lambda > \lambda d - 2\pi,$$

where, λd represents the wrap angle of said wraps when the volume of said compression spaces is minimized.

2. A scroll-type fluid machine according to claim 1, wherein said pressure-equalizing ports take positions substantially near the positions expressed by λd.

3. A scroll-type fluid machine according to claim 1, wherein said pressure equalizing ports are formed in the end plate of said orbiting scroll member.

4. A scroll-type fluid machine according to claim 1, wherein said pressue equalizing ports are disposed at positions wherein said pressure-equalizing ports are closed once by the wrap of the opposing scroll member during one cycle of the orbiting motion.

5. A scroll-type fluid machine according to claim 4, wherein said pressure-equalizing ports are small ports and are disposed at positions slightly spaced from a wall of the wrap of said orbiting scroll member.

6. A scroll-type fluid machine according to claim 4, wherein each of said pressure equalizing ports has a diameter substantially equal to a width of the wrap of the opposing scroll member and is disposed in contact with the wrap wall of said orbiting scroll member.

* * * * *